United States Patent [19]

Lewis

[11] 4,359,738

[45] Nov. 16, 1982

[54] CLUTTER AND MULTIPATH SUPPRESSING SIDELOBE CANCELLER ANTENNA SYSTEM

[75] Inventor: Bernard L. Lewis, Oxon Hill, Md.

[73] Assignee: The United States of America as represented by the Secretary of the Navy, Washington, D.C.

[21] Appl. No.: 824,574

[22] Filed: Aug. 9, 1977

Related U.S. Application Data

[63] Continuation-in-part of Ser. No. 528,193, Nov. 25, 1974, abandoned.

[51] Int. Cl.[3] ..... H01Q 109/06

[52] U.S. Cl. ..... 343/100 LE; 343/754

[58] Field of Search ..... 343/100 LE, 100 CL, 343/100 SA, 754, 753, 757, 854

[56] References Cited

U.S. PATENT DOCUMENTS 3,090,956 5/1963 Woodward, Jr. et al. ..... 343/100
3,202,990 8/1965 Howells ..... 343/100
3,754,270 8/1973 Thies, Jr. ..... 343/754
3,958,246 5/1976 Wohler et al. ..... 343/754

*Primary Examiner*—Theodore M. Blum
*Attorney, Agent, or Firm*—Robert F. Beers; William T. Ellis; Philip Schneider

[57] ABSTRACT

An improved antenna and interference-cancelling system for improving signal sampling, particularly in side-lobe canceller system operating in a multiple-interference-source environment. An antenna is constructed as a circularly symmetric lens having loosely coupled feed elements disposed around the periphery of the lens. Each feed element acts as a high-azimuth-gain antenna which permits signal reception from all directions. The lens, when connected to couple the receiving feed elements to a side-lobe canceller, permits the canceller to discriminate against clutter and scattered signals and resolve interference sources in angle so that all canceller loops do not receive signals from all other interference sources, while still providing interference samples from all directions.

16 Claims, 3 Drawing Figures

CLUTTER AND MULTIPATH SUPPRESSING SIDELOBE CANCELLER ANTENNA SYSTEM

BACKGROUND OF THE INVENTION

This application is a continuation-in-part of the U.S. patent application Ser. No. 528,193, filed Nov. 25, 1974 now abandoned.

The present invention relates to improvements in antennas and interference-suppression systems and more particularly to techniques for improving multiple side-lobe canceller operation.

Generally, interference-suppression systems are designed to reduce the presence of undesired signals in a signal receiving system. As is known, in particular systems such as radar systems, the characteristics of the receiving antenna are such that undesired signals which are received in the side-lobes interfere with isolation of the target signal received in the main lobe. Accordingly, in order to isolate the main-lobe signals, various side-lobe cancelling systems have been proposed to cancel interference from the side-lobes of a main radar antenna. While such systems have been relatively successful in cancelling interference from a single source with a single canceller loop, conventional systems have been less effective in reducing interference from multiple sources even where multiple canceller loops are employed.

In one system, as exampled by U.S. Pat. No. 3,202,990, a plurality of omnidirectional auxiliary antennas are used to sample the radar environment. The sampled signals are then used as the auxiliary inputs to a system of canceller loops where they are phase-shifted and amplitude-weighted and subtracted from the main radar antenna signal to reduce interference. Since omnidirectional antennas are used, the auxiliary signal provided by each antenna represents equal-gain interference signals from all interference sources along with any clutter or scattered signals. Such a condition has been found to cause an interaction in the operation of the canceller loops which significantly reduces and limits the effectiveness of interference reduction in the over-all system.

Another system, as exampled by U.S. Pat. No. 3,177,489, employs a plurality of directional auxiliary antennas each aligned with a significant side-lobe of a primary directional antenna. Each of the antennas, therefore, supplies a separate signal from each side-lobe direction to the appropriate amplitude and timing circuits for reduction of interference in the primary antennas signal. As recognized, some problems, normally caused by the interaction of signals which are not separately derived, are reduced by using the directional auxiliary antennas. However, directional auxiliary antennas can be expensive and physically limiting in size, construction, and position in a particular system. In addition, to protect the radar from interference from all side-lobes, many such antennas would be required if size limitations did not prohibit protection of all side-lobes.

Accordingly, the present invention has been developed to overcome the specific shortcomings of the above and similar techniques and to provide an antenna and canceller system of improved performance and versatility in a multiple interference-source environment.

SUMMARY OF THE INVENTION

It is therefore an object of the present invention to provide an improved antenna and interference-suppression system which is simple to implement yet highly reliable in operation.

Another object of the invention is to provide an improved antenna of the lens type that can receive signals simultaneously from all directions, particularly of the two-dimensional lens type.

A still further object of the invention is to provide an antenna having loosely coupled feeds to prevent signal blockage in any direction.

Still another object of the invention is to provide a side-lobe canceller system that permits cancellation of interference from any side-lobe of a primary antenna.

A still further object of the invention is to provide an antenna and side-lobe canceller system which reduces interaction between multiple canceller loops.

Yet another object of the invention is to provide a side-lobe canceller system which resolves interference sources in angle to provide separate signals to each canceller loop in a multiple-source environment, and suppresses clutter and scattered signals.

Still another object of the invention is to provide a lens antenna that can be conveniently mounted directly below a primary antenna phase center to more easily achieve correlation between received signals.

In order to accomplish the above and other objects, the invention provides an improved antenna for signal-viewing in all directions. In the present invention, the feed elements of a circularly symmetric lens antenna are disposed around the periphery of the lens and loosely coupled so that energy can be received in all directions through the lens. Each element taken with the lens forms a high-gain antenna, the elements being arranged such that the lens covers all possible azimuth angles. Due to the characteristics of the lens antenna, each feed element resolves a particular angle for the signal received by that element. Each of the elements are then coupled to provide auxiliary signals to individual side-lobe canceller loops such that each loop receives signals from an interference source in a particular direction while still allowing viewing in all directions. In this manner, the separate inputs can provide independent interference samples and at the same time suppress scattered and clutter signals in other directions, thereby avoiding interaction between canceller loops which would otherwise degrade performance. In addition, by mounting the lens antenna below the primary-antenna phase center, correlation between the primary antenna and lens antenna signals is more easily achieved.

Other objects, advantages and novel features of the invention will become apparent from the following detailed description of the invention when considered with the accompanying drawings wherein:

DETAILED DESCRIPTION OF THE PREFERRED EMBODIMENT

Figure 1:
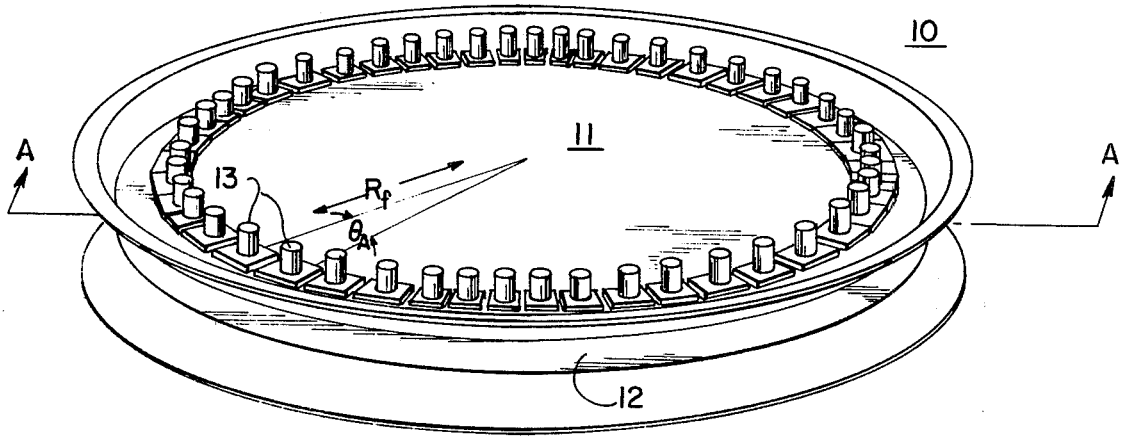
FIG. 1 is a perspective view showing a particular embodiment of the lens antenna of the present invention.

Referring now to FIG. 1, a perspective view is shown of a preferred embodiment of the lens antenna according to the present invention. In this example, a two-dimensional, parallel-plate, constant-k (dielectric constant) lens antenna 10 is illustrated, although the lens antenna could also be constructed as any well-known Luneberg lens, geodesic lens, or any other dielectrically loaded parallel-plate lens operating in the TEM mode or waveguide mode with the plate spacing determining the phase velocity. The characteristics and construction of such antennas are generally well-known and will therefore not be discussed in great detail.

Figure 2:
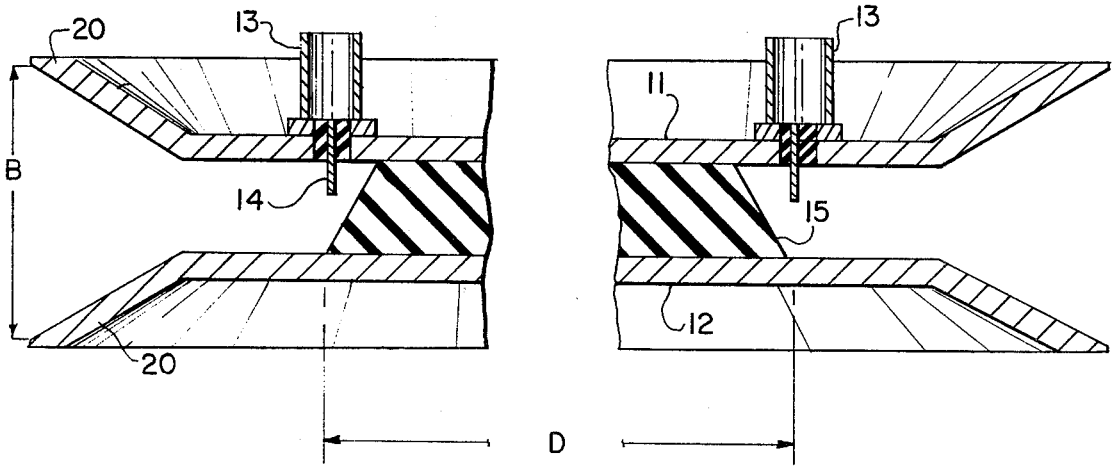
FIG. 2 is a cross sectional view of the antenna of FIG. 1 taken along the line AA.

Briefly, however, as shown in FIG. 2, the lens antenna is constructed from two parallel, spaced, circular metal plates 11 and 12 having flared peripheries 20 forming a horn aperture and from a circular uniform-dielectric material 15 which is sandwiched concentrically between plates 11 and 12 and forms the dielectric lens. Conventionally, a plane wave entering the periphery of the lens will be focused at a focal point which is a point diametrically opposite the point of entry, Thus, the lens antenna is capable of receiving signals from all directions and focusing the signal to act as a high-gain azimuth antenna in any direction. It should be noted that the lens receives EM energy from space and operates on it directly focusing it without the action of any feed element. (Hereinafter, the use of the term "lens antenna" will imply the above-described type of antenna and lens.)

In prior art systems, however, in order to receive the signals received and focused by the lens, and to transmit signals from feed elements through the lens to space, a plurality of feed elements were tightly coupled at the focal points along a portion of the lens periphery, or a movable feed horn was provided to scan the periphery in time over 360°. In either case, the tightly coupled feeds caused blockage of signals from some directions and were incapable of simultaneous 360° viewing. While stacking of a plurality of lenses having staggered feed elements allowed 360° viewing, the same required extensive increases in the number of elements and complexity of the system.

In contrast to such limitations of the prior art, the present invention allows simultaneous viewing over 360° without blockage by antenna feeds. Referring back to FIGS. 1 and 2, the feed elements according to the present invention are shown as a plurality of dipole elements equally spaced circumferentially around the lens. The dipole elements are formed from a coaxial cable connector having a center conductor 14 having a longitudinal axis extending substantially perpendicularly through the plate 11, and an outer coaxial conductor 13 electrically attached to the metal plate 11 and electrically insulated from the inner conductor 14 by an insulating sleeve. Contrary to conventional feeds, the center conductor 14 is positioned to extend only partially through the gap between the plates 11 and 12 to form a loosely coupled feed dipole according to the invention. The feed elements are positioned from the center of the lens at a point where the distance from the center of the lens to the longitudinal axis of the center contuctor 14 is the focal radius $R_f$ of the lens. This is the point where maximum energy is focused and a minimum beam width obtained for any plane wave entering the periphery of the lens. The elements are spaced from one another such that the angle between the longitudinal axis of the center conductors as measured from the center of the lens (i.e., the angle between any two adjacent focal radii) is $\theta_A$ as shown by FIG. 1, where $\theta_A = \text{arc sin } \lambda/D$ and where $\lambda$ is the operating wavelength and D is the diameter of the lens as shown in FIG. 2. For systems anticipating reception of various frequencies, the value of $\gamma$ determining angle spacing should be that for the highest frequency expected to be received. At this spacing each feed element looks through the lens to provide a high azimuth-gain antenna whose azimuth field-of-view is limited to the angle defined by the same known relationship $\theta = \text{arc sin } \lambda/D$, thus allowing viewing by the lens antenna in all directions. At the same time, the elevation field-of-view $\theta_E$ is controlled by the aperture of the horns into which the two-dimensional lens is flared, giving an elevation field-of-view defined by the known relationship $\theta_E = \text{arc sin } \lambda/B$, where B is the known aperture as shown in FIG. 2. Since the center conductors 14 extend only partially through the plate gap to form the loosely coupled feeds, the feed elements on one side of the lens do not block the feed elements on the other side of the lens by high absorption of energy, thereby allowing a substantially unobstructed simultaneous viewing and signal reception through 360°. While various degrees of coupling may be obtained by controlling the extension of 14 into the plate gap, the ideal coupling has been found to be such that the effective area of all feeds would be one-half that of the feed region of the lens. The gain of each feed and lens combination could then be defined by the known relationship $$G = \tfrac{1}{4}\left[\frac{2\pi}{\text{arc sin } \frac{B}{\lambda}}\right] \cdot \left[\frac{2\pi}{\text{arc sin } \frac{D}{\lambda}}\right].$$

By then coupling a coaxial feed line to the coaxial connector portions 13 and 14, the lens antenna provides a plurality of high-gain outputs with each representing an angle direction for a total azimuthal angle of 360°. Of course, due to the focusing of the EM energy by the lens, only one or two of the feed elements acts as a high-gain receptor element at any one time for EM energy coming from a single direction.

Figure 3:
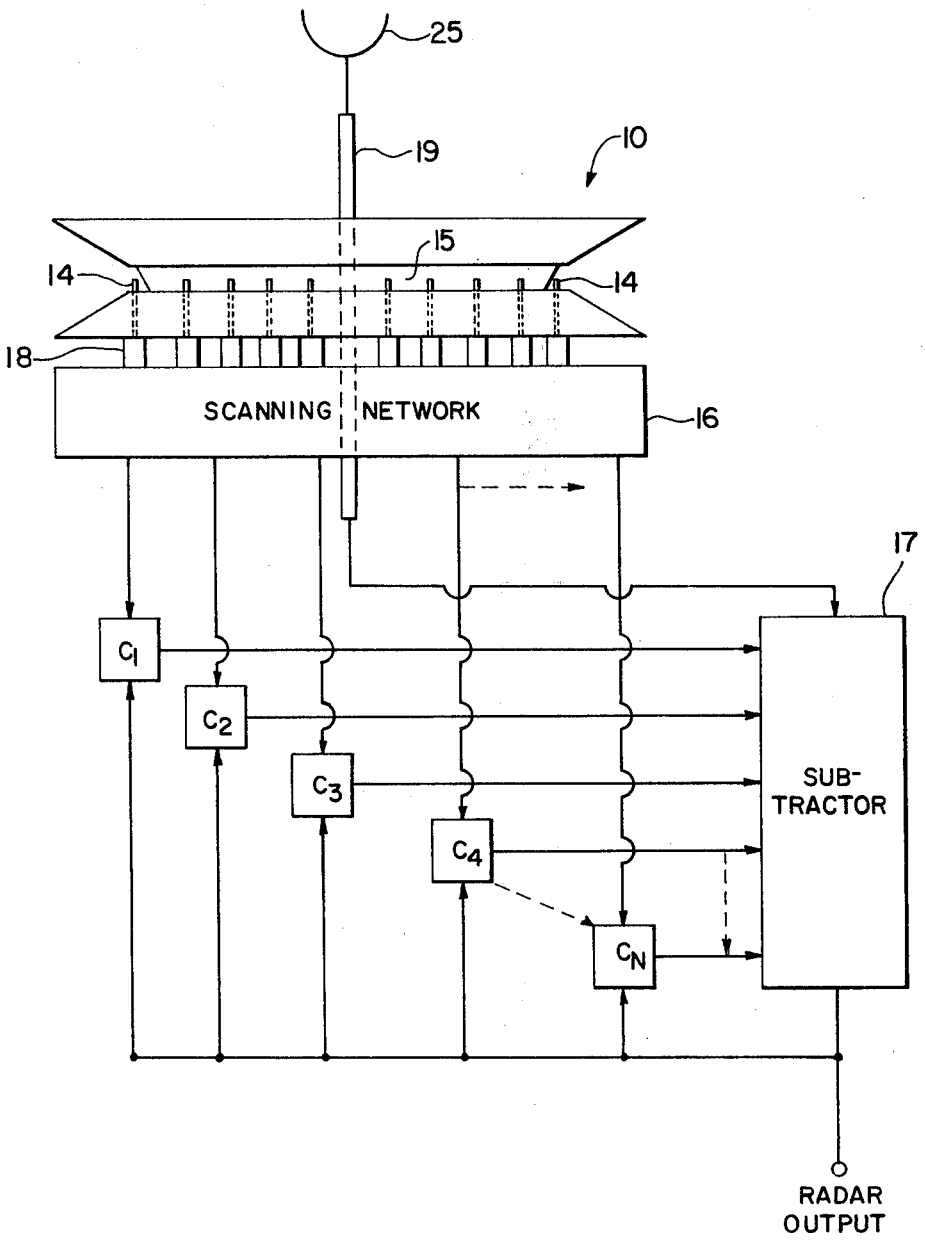
FIG. 3 is a schematic diagram of the canceller system according to the present invention utilizing the antenna of FIG. 1.

Turning now to FIG. 3, the improved canceller system according to the present invention is shown using the inventive antenna of FIG. 1 and 2. In the present example, the invention will be described with reference to a radar system having primary directional radar antenna 25 forming a main channel input, and the lens antenna 10 providing the auxiliary channel inputs. The radar antenna 25 forms the main channel sensor for receiving radar signals and any interference that may be present from the side-lobes. The lens antenna 10 forms a plurality of auxiliary channel sensors (feed elements) that receive primarily interference signals or samples of the interference environment in which the radar is attempting to operate. The antenna 25 is mounted on a scanning mast 19 such that the phase center of the antenna 25 lies at the center of the shaft 19. The shaft 19 in turn extends vertically through the center of lens antenna 10 and perpendicular to the plates 11 and 12, and carries the electrical connections delivering the signals received at 25. The shaft may be mounted for rotation in any conventional manner known in the art. Each of the feed elements of antenna 10 is connected to a coaxial cable generally represented at 18 to provide the outputs representing the signals received from all directions. The cables 18 are then coupled to a scanning network 16 which is designed to allocate signals received at 18 to a fixed number of N feed lines to cancellers $C_1$–$C_N$. While the lines 18 could all be directly coupled to individual canceller loops, as a practical matter interference signals will not be received from all feed elements simultaneously. The scanning network is, therefore, constructed as any conventional mechanical or electrical switching network having threshold circuits for sensing a predetermined magnitude representing an interference signal, and having a fixed number of N outputs over which any interference signals received on lines 18 are provided as separate auxiliary signals to cancellers $C_1$–$C_N$. For simplicity, the conventional radar and auxiliary receivers have been omitted from the drawing since they are unnecessary to an understanding of the invention, it being obvious that such receivers are incorporated to receive and process the antenna signals from 25 to 18 in a manner well-known in the art.

The main channel signal from 25, after passing through the radar receiver (not shown), is electrically coupled as one input to the subtractor 17. In a like manner the auxiliary channel signals from 16 (or from 18 if no scanning network is used), after passing through auxiliary receivers (not shown), are coupled as inputs to cancellers $C_1$–$C_N$. Cancellers $C_1$–$C_N$ are conventional cancellers having outputs connected to subtractor 18, whose output in turn is connected back to the cancellers $C_1$–$C_N$ to form a plurality of adaptive side-lobe canceller loops. The canceller system according to the present invention may include the multiple side-lobe canceller loops parallel-connected as exampled by U.S. Pat. No. 3,202,990 or any other connection of adaptive loops such as that shown by U.S. Pat. No. 3,938,153 entitled "Improved Sidelobe Canceller System" to Bernard L. Lewis and Irwin D. Olin and U.S. Pat. No. 3,938,154 entitled "Modified Sidelobe Canceller System" to Bernard L. Lewis, both issued Feb. 10, 1976 and assigned to the same assignee as the present invention. In any case, the system is designed such that each of the auxiliary signals is supplied to a separate canceller loop for decorrelating the signal at 25 to reduce interference.

The operation of the inventive system will now be described with reference to FIG. 3. When a plurality of interference sources (in this case jammers) are providing interference signals from different directions, the signal received by the radar antenna includes a radar signal carrier modulated by the radar signal and a plurality of jammer carriers having the same frequency, but different amplitude and phase, modulated by the jammer waveform. At the same time, the interference signals are also viewed by the lens antenna 10 which provides the interference signals resolved in angle over cables 18. As previously noted, the lens 10 is positioned such that the support 19 and associated electrical connections extend vertically through the center of the lens thereby allowing unobstructed and simultaneous 360° viewing of all the regions viewed by the radar antenna. While the support 19 extending through the lens 10 will tend to cause a blockage of some received energy, it can be seen that by controlling the diameter D of the lens 15 and the diameter d of the shaft 19 such that the ratio $$\frac{D}{d}\ \frac{\text{(effective aperture)}}{\text{(blocked aperture)}}$$

is large, the blockage will be insignificant in the antenna system. The signals at 18 representing interference signals from different directions provide the independent auxiliary channel signals which are electrically coupled to individual canceller loops $C_1$–$C_N$ either directly or through scanning network 16. At this point, the cancellers $C_1$–$C_N$ in conjunction with the subtractor 17 act in the conventional manner as previously described to reduce interference in the main channel (radar) output from 17.

In contrast to the prior art systems where each of the auxiliary channel inputs were provided by omnidirectional antennas viewing all interference sources, the auxiliary channel inputs from 18 of the present invention, provide simultaneous but separate interference samples resolved in angle for all interference sources, with each sample coupled to an individual one of a plurality of side-lobe canceller loops. Due to the separate signals, interaction between the canceller loops is substantially eliminated resulting in a corresponding increase in the cancellation that can be achieved by the system. In addition, since each of the feed elements only sense in one azimuth direction, clutter and scattered signals that may be generally present in the direction of the main lobe of the primary antenna, are not received by the feed elements sensing interference in the direction of the side-lobes of the main antenna. This results in a suppression of the clutter and scattered signal interference which would otherwise interfere in the canceller loops with the signals from the jamming sources. Further, since the phase center of the lens antenna can be placed directly below the phase center of the primary antenna, the signals received by the antenna elements and provided for the canceller loops can be more easily correlated. By way of example, using only a delay line inserted to delay the signal from 25, the signals received by the radar antenna could be delayed in time so that main channel and auxiliary channel interference signals arrive at the canceller loops at substantially the same time regardless of the scan position of the radar.

As can be seen from the above description of the present invention provides numerous advantages over the conventional antenna and side-lobe canceller systems. In addition to those already mentioned, the inventive lens antenna, as a unitary structure in the inventive canceller system, reduces the number and therefore the cost and complexity of elements forming the system. The lens antenna lends itself well to incorporation with conventional canceller loops without the need for special electrical or mechanical couplings. Using only simple modifications to conventional lens structure to provide loosely coupled feeds, simultaneous reception and angle resolution without blockage in any direction is easily achieved. These observed characteristics and others mentioned lead to the improved cancellation according to the present invention.

Obviously many modification and variations of the present invention are possible in light of the above teachings. It is therefore to be understood that within the scope of the appended claims the invention may be practiced otherwise than as specifically described.

What is claimed and desired to be secured by Letters Patent of the United States is:

1. An apparatus for processing signals from a multiple interference source environment comprising:

a single, circular, symmetric lens member formed from a pair of substantially identically shaped, circular, electrically conductive plates the peripheries of which are flared and from a lens comprising a circular slab of dielectric material of approximately the same radius as that of the unflared portions of said plates, said dielectric lens being placed between and separating said plates so that the flared ends form a waveguide horn, said lens being concentric with said plates; and a plurality of loosely coupled feed elements disposed symmetrically around the periphery of said lens, said dielectric lens being coupled directly to any impinging electromagnetic wave energy without the intervening action of any said feed element and focusing the energy of any electromagnetic plane wave at a focal point near its periphery opposite the point at which the plane wave energy first strikes the lens, said loose coupling of said feed elements preventing high absorption of incoming energy by any feed element except that one at the point at which the energy is focused or the two flanking the focal point.

2. The apparatus of claim 1 wherein each of said feed elements is positioned at a point along the periphery of said lens such that the distance from the center of said lens to each feed element is equal to the focal radius of said lens.

3. The apparatus of claim 2 wherein each of said elements are spaced around said periphery at an angle $\theta$ measured from the center of the lens, where $\theta = \text{arc sin } \lambda/D$, and where $\lambda$ is the wavelength of received energy and D is the diameter of the antenna lens.

4. The apparatus of claim 3 wherein said lens antenna is a two-dimensional, parallel-plate, constant-K lens antenna where K is the dielectric constant of the lens.

5. The apparatus of claim 4 wherein each of said feed elements is a dipole feed comprising, a coaxial connector having a center conductor extending substantially perpendicularly through one of said parallel plates and partially through the gap between said plates and a coaxial outer conductor electrically coupled to said one of said parallel plates.

6. The apparatus of claim 1 further including:

a main channel sensor constructed to receive desired and interference signals; and canceller means electrically coupled to said main channel sensor and said feed elements for cancelling interference in said main channel signals and providing a main channel output.

7. The apparatus of claim 6 wherein said canceller means comprises:

a subtractor having a first input, a plurality of second inputs to be subtracted from said first input, and an output forming said main channel output;

a plurality of individual cancellers each having first and second inputs and an output, with the output of each canceller connected as one of said second inputs to said subtractor, and the output of said subtractor connected as the second input to each canceller to form a plurality of canceller loops; and means coupled to said feed elements for coupling received energy on each of said elements to separate cancellers through said first inputs of said plurality of cancellers.

8. The apparatus of claim 7 wherein the main channel sensor is a directional antenna and the lens antenna is mounted beneath the directional antenna such that the center of the lens lies vertically beneath the phase center of the directional antenna.

9. The apparatus of claim 8 wherein each of said feed elements is positioned at a point along the periphery of said lens such that the distance from the center of said lens to each feed element is equal to the focal radius of said lens.

10. The apparatus of claim 9 wherein each of said elements are spaced around said periphery at an angle $\theta$ measured from the center of the lens, where $\theta = \text{arc sin } \lambda/D$, and where $\lambda$ is the wavelength of received energy and D is the diameter of the antenna lens.

11. The apparatus of claim 10 wherein said lens antenna is a two-dimensional, parallel-plate, constant-K lens antenna where K is the dielectric constant of the lens.

12. The apparatus of claim 11 wherein each of said feed elements is a dipole feed comprising a coaxial connector having a center conductor extending substantially perpendicularly through one of said parallel plates and partially through the gap between said plates and a coaxial outer conductor electrically coupled to said one of said parallel plates.

13. Electromagnetic energy antenna apparatus comprising in combination:

a lens antenna having a circular lens of dielectric material of constant K, lying between a pair of substantially identically shaped, electrically conductive plates, said dielectric lens being coupled directly to any impinging electromagnetic wave energy and focusing the energy of any impinging electromagnetic plane wave at a focal point near its periphery opposite the point at which the plane wave first strikes the lens, said lens also being capable of acting in the reverse direction;

and a plurality of loosely coupled feed elements disposed symmetrically around the periphery of said lens, the loose coupling of the feed elements preventing high absorption of incoming energy by any feed element except the one or two nearest the point at which the energy is focused by the dielectric lens.

14. Antenna apparatus as in claim 13, wherein said lens antenna further comprises:

a pair of substantially identically shaped, circular, electrically conductive plates the peripheries of which are flared, the plates being disposed so that they are concentric with, spaced from, and parallel to each other, so that they form a central waveguide section with a peripheral waveguide horn, said lens being formed of a circular slab of material which fills the central waveguide section of the spaced plates.

15. Antenna apparatus as in claim 14, wherein in each of said feed elements are spaced around said periphery at an angle $\theta$ measured from the center of the lens, where $\theta = \text{arc sin } \lambda/D$, and where $\lambda$ is the wavelength of received energy and D is the diameter of the antenna lens.

16. Antenna apparatus as in claim 14, wherein each of said feed elements is a dipole feed comprising a coaxial connector having a center conductor extending substantially perpendicularly through one of said parallel plates and partially through the gap between said plates and a coaxial outer conductor electrically coupled to said one of said parallel plates.

* * * * *